US011015621B2

(12) United States Patent
Dandamudi et al.

(10) Patent No.: US 11,015,621 B2
(45) Date of Patent: May 25, 2021

(54) PROPORTIONAL CONTROL FLUID ACTUATOR

(71) Applicant: Air Power Systems Co., LLC, Tulsa, OK (US)

(72) Inventors: Vinay Kumar Dandamudi, Tulsa, OK (US); Kenneth E. Thompson, Garfield, AR (US); Ryan S. Tietz, Mounds, OK (US)

(73) Assignee: Air Power Systems Co., LLC, Tulsa, OK (US)

( * ) Notice: Subject to any disclaimer, the term of this patent is extended or adjusted under 35 U.S.C. 154(b) by 0 days.

(21) Appl. No.: 16/670,246

(22) Filed: Oct. 31, 2019

(65) Prior Publication Data

US 2020/0400164 A1 Dec. 24, 2020

Related U.S. Application Data

(60) Provisional application No. 62/865,547, filed on Jun. 24, 2019.

(51) Int. Cl.
*F15B 9/08* (2006.01)
*F15B 13/04* (2006.01)

(52) U.S. Cl.
CPC ..... *F15B 9/08* (2013.01); *F15B 13/0401* (2013.01)

(58) Field of Classification Search
CPC ..... F15B 9/08; F15B 13/0401
See application file for complete search history.

(56) References Cited

U.S. PATENT DOCUMENTS 2,401,680 A * 6/1946 Eaton ..... B64C 13/00 91/1
3,991,661 A 11/1976 Mocha
5,125,326 A * 6/1992 Sarcona ..... F15B 11/122 74/364
8,297,586 B1 * 10/2012 Thompson ..... F15B 15/1476 251/63.6

* cited by examiner

*Primary Examiner* — Thomas E Lazo
(74) *Attorney, Agent, or Firm* — GableGotwals

(57) ABSTRACT

A proportional control fluid actuator that is used as a positioning device in applications such as a hydraulic directional control valve. The activating device has a cylinder body attachable to a valve body and has a bore carrying a piston that is coaxially secured to an end of a valve spool. The device is provided with spaced openings in the cylinder body that communicate with the bore therein to introduce fluid to act on opposite sides of the piston. Factory pre-compressed spring means are provided for normally urging the piston and spool to a center position. Since the areas of the fluid pressure applied on both sides of the piston are different (due to a spool on one side of the piston), two pre-compressed springs are used to compensate the area difference to achieve a proportional movement of the spool.

20 Claims, 5 Drawing Sheets

PROPORTIONAL CONTROL FLUID ACTUATOR

CROSS-REFERENCE TO CO-PENDING APPLICATIONS

This application claims priority to U.S. Provisional Application No. 62/865,547, filed Jun. 24, 2019, the entire application is incorporated herein by reference.

FIELD OF THE DISCLOSURE

The disclosure relates to a fluid powered actuator having a piston reciprocally positioned to move to three different positions. In particular, the present disclosure is directed to a fluid powered actuator which will reciprocate the piston proportionally to the applied fluid pressure.

BACKGROUND

Various types of fluid actuators are utilized for moving various types of machinery from one position to another position. These actuators utilize fluid to force a piston within a bore to move a shaft and may be either hydraulic or pneumatic. In one type of actuator, fluid pressure is directed to either side of the piston within a fluid tight cylinder to move the piston between positions. Three position actuators are known, such as Assignee's own actuator shown in U.S. Pat. No. 3,991,661.

Oftentimes, actuators are attached to the end of a hydraulic valve spool to raise or lower equipment such as a dump bed of a trailer or to extend or retract a hydraulic cylinder on various types of equipment. The actuator may be attached to the spool of the hydraulic valves. Therefore, an effective area in a fluid chamber on the spool side is less than an effective area in the opposite chamber by same amount as the area of the spool. As a result, response of the piston movement to the applied pressure is different in extend and retract directions.

SUMMARY

Embodiments of the present disclosure provide a fluid powered actuator that will respond proportionally to an applied fluid pressure. The fluid actuator includes a piston that is reciprocally positioned within a cylindrical chamber of a body of the actuator. The piston has a channel formed on its external circumferential surface. An O-ring or other seal mechanism resides in the channel to engage an interior wall of the cylindrical chamber and to form a fluid tight seal therewith. The piston includes an axial opening through which a piston shaft passes.

The piston shaft includes multiple steps, an O-ring groove, and a snap ring groove on its surface. The piston shaft passes through a flange bushing and piston while compressing a spring in between them. The piston is held on the piston shaft by the means of the snap ring. The piston shaft is passed through another flange bushing for compressing another spring in between the piston and second flange bushing. The second flange bushing is stopped at the end of the piston shaft. The force of the compression springs on the both sides of the piston will urge the piston to a center position.

The cylindrical chamber forms a fluid tight chamber that may be pressurized. Fluid to the cylindrical chamber is delivered by one of two fluid passageways, i.e., a first fluid passageway and a second fluid passageway. Spring rates and initial compression of the springs are calculated based on the area of the piston, the area of the spool and required working ranges of the fluid pressure. For purposes of this application, "neutral positioning force" is defined as a minimum force required to return the actuator to the neutral position and provide positive holding force to maintain the neutral position when no control fluid pressure is present. Actuator springs are pre-loaded to forces greater than or equal to the desired neutral positioning force. The design described has springs on opposing sides of the piston, but the springs are never at a condition of force equilibrium. The following calculations may be used to determine the required spring rate and initial compression:

Let the area of the piston be $A_p$ and Area of the spool be $A_s$. Let the spring rate of a first spring in a first chamber be $K_1$ and that of a second spring in a second chamber be $K_2$. Let the drag force due to the O-rings be $F_d$. Let the stroke of the actuator be S, fluid pressure in the first chamber is $P_1$ and fluid pressure in the second chamber is $P_2$. Preload in the first spring be $PL_1$ and preload in the second spring is $PL_2$.

The area of the fluid pressure application in the first chamber is $A_1=A_p$.

The area of the fluid pressure application in the second chamber is $A_2=A_p-A_s$.

The free body diagram of FIG. 1 shows forces acting on a piston when starting pressure ($P_{1s}$) is applied to chamber 1.

The free body diagram of FIG. 2 shows forces acting on a piston when ending pressure ($P_{IE}$) is applied to chamber 1.

The free body diagram of FIG. 3 shows forces acting on a piston when starting pressure ($P_{2S}$) is applied to chamber 2.

The free body diagram of FIG. 4 shows forces acting on a piston when ending pressure ($P_{2E}$) is applied to chamber 2.

From the above free body diagrams, we get the starting pressure $P_{1S}$ and ending pressure $P_{IE}$ when pressure is applied in the first chamber for a given stroke S are as follows.

$$P_{1S}=(PL_2+F_d)/A_1;$$

$$P_{1E}=(PL_2+F_d+K_2S)/A_1;$$

From the above free body diagrams, we get the starting pressure $P_{2S}$ and ending pressure $P_{2E}$ when pressure is applied in the second chamber for a given stroke S as follows.

$$P_{2S}=(PL_1+F_d)/A_2;$$

$$P_{2E}=(PL_1+F_d+K_1S)/A_2;$$

Since A1>A2, the preloads and spring rates of the springs must be adjusted to make the actuator work in the required pressure ranges.

For purposes of this application, a "proportional positioning actuator" is an actuator wherein fluid pressure is applied to a double acting piston that generates a force acting against a spring, which results in a linear displacement that is proportional to the control fluid pressure.

The design described allows for wider control pressure range and greater ability to configure the minimum pressure at which the actuator begins to move from neutral and the pressure at which the actuator is at maximum displacement.

The actuator of the invention having a piston with only one response to the applied fluid pressure in either directions (extend or retract). This actuator can ensure more precise control of the equipment such as dump bed or hydraulic cylinder.

It is a further object and purpose of the present disclosure to provide a fluid actuator having a piston that can be held at a position in the range of its travel to ensure different flow rates in the hydraulic valves.

It is a further object and purpose of the present disclosure to provide a fluid actuator comprised of readily available components that is simple to assemble and install.

DETAILED DESCRIPTION OF THE PREFERRED EMBODIMENTS

Figure 1:
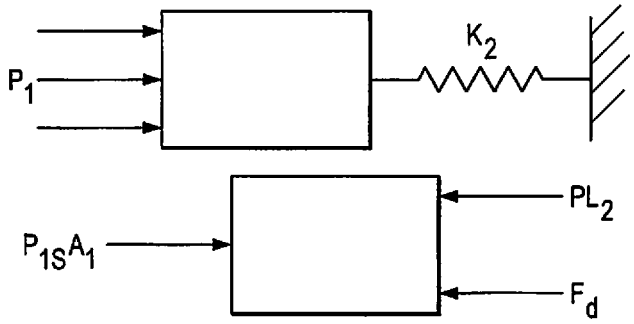
FIG. 1 is a free body diagram showing forces acting on a piston when a starting pressure is applied to a first chamber.
Figure 2:
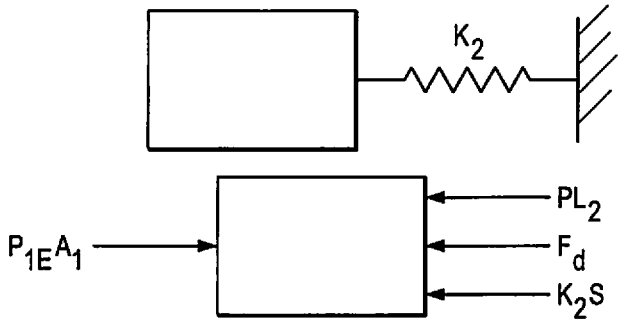
FIG. 2 is a free body diagram showing forces acting on a piston when ending pressure is applied to the first chamber.
Figure 3:
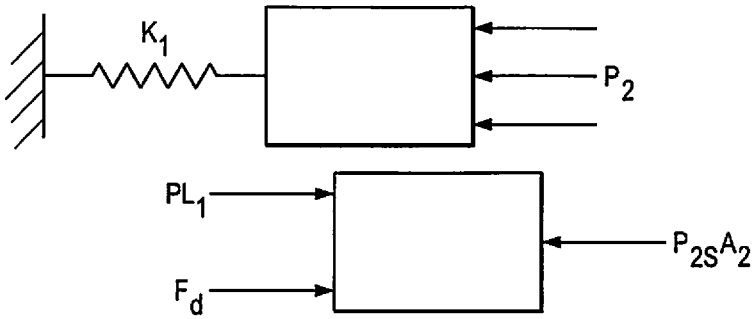
FIG. 3 is a free body diagram showing forces acting on a piston when a starting pressure is applied to a second chamber.
Figure 4:
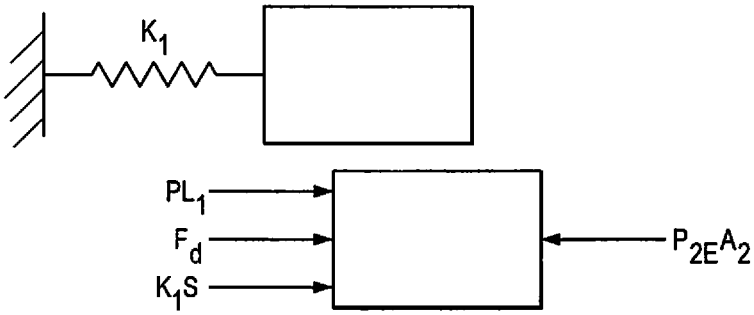
FIG. 4 is a free body diagram showing forces acting on a piston when an ending pressure is applied to the second chamber.
Figure 5:
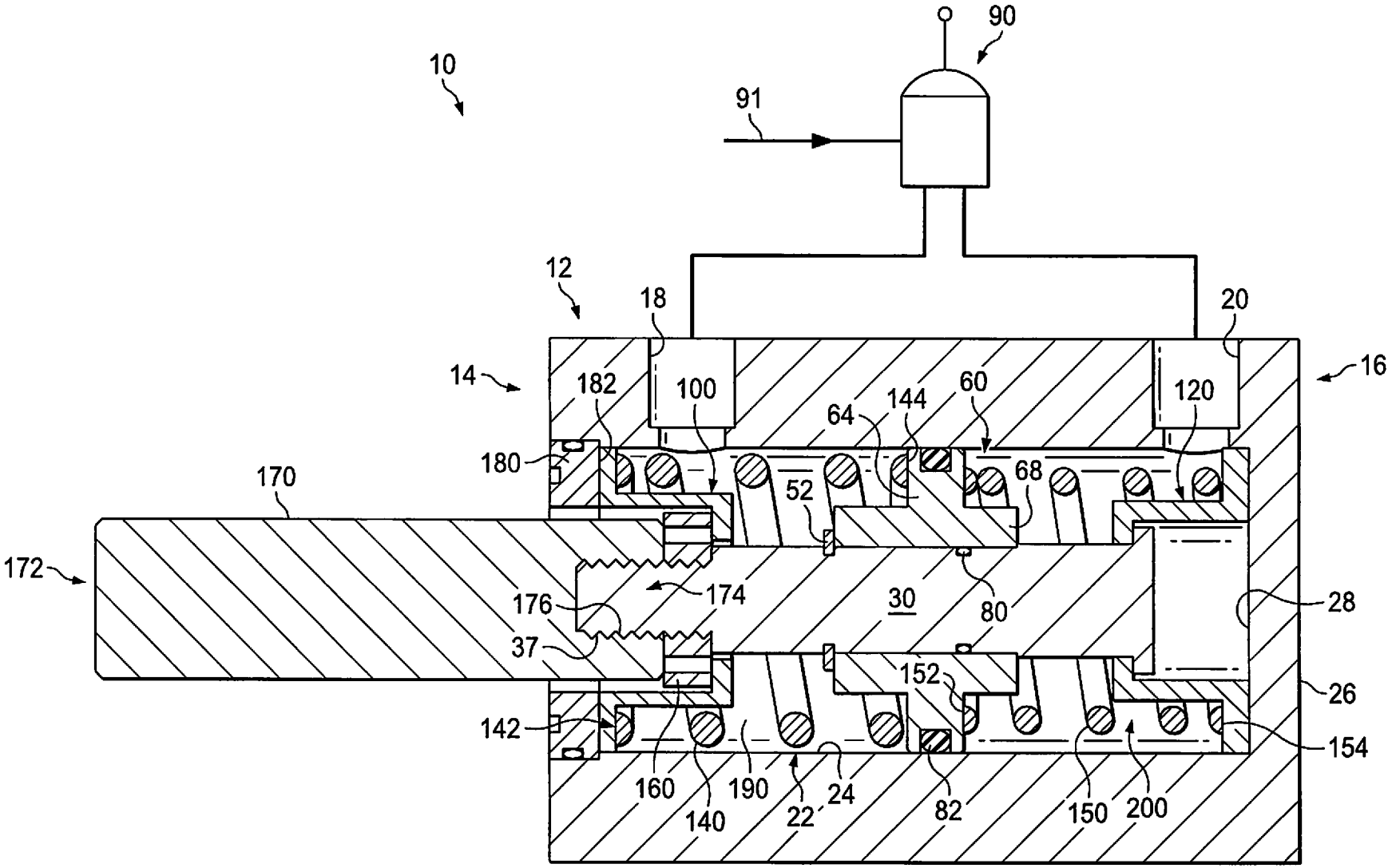
FIG. 5 is a schematic and cutaway elevational view of an embodiment of the control fluid actuator of this disclosure in a neutral position.
Figure 6:
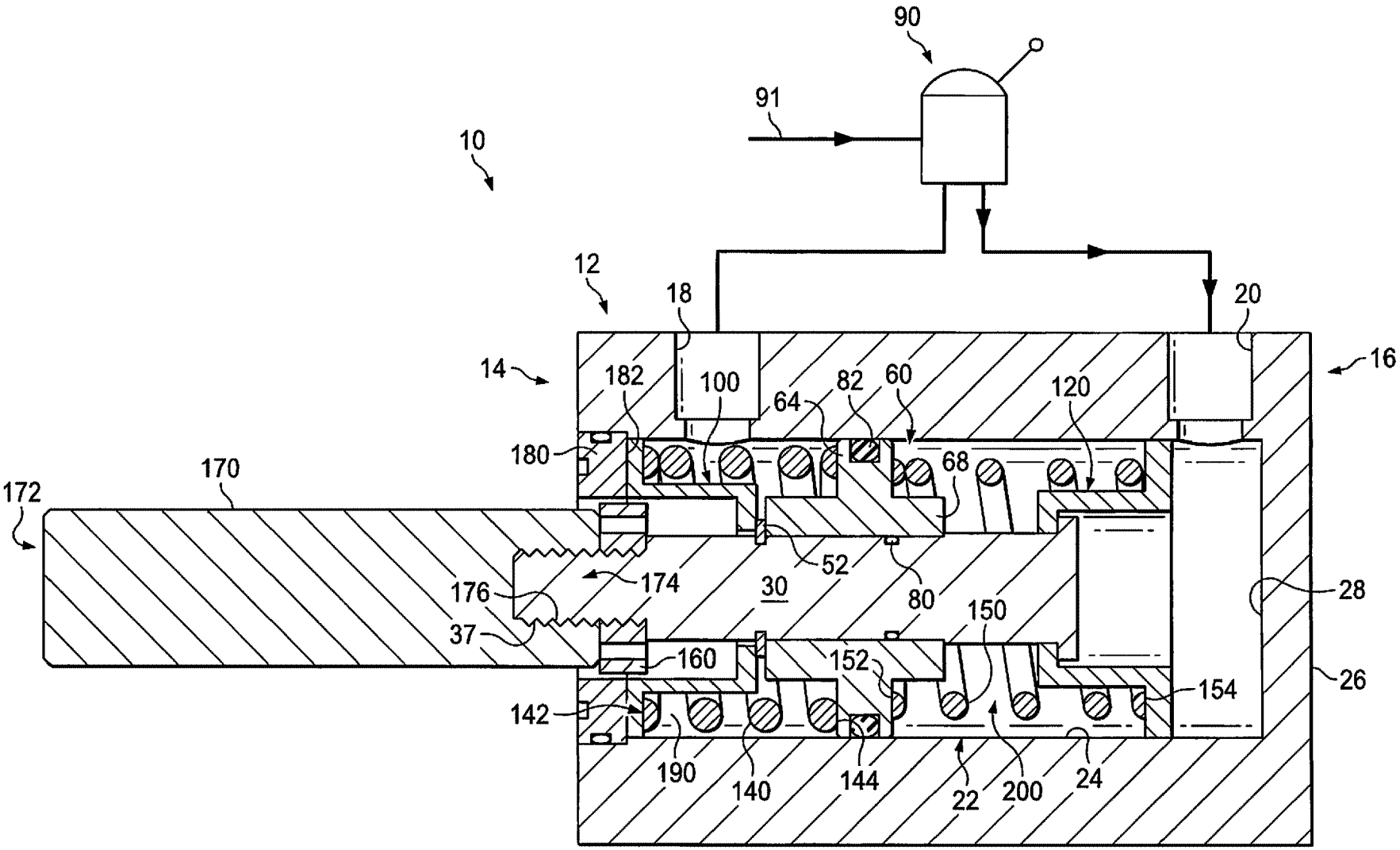
FIG. 6 is a schematic and cutaway elevational view of the control fluid actuator of FIG. 5 shown in an extended position.
Figure 7:
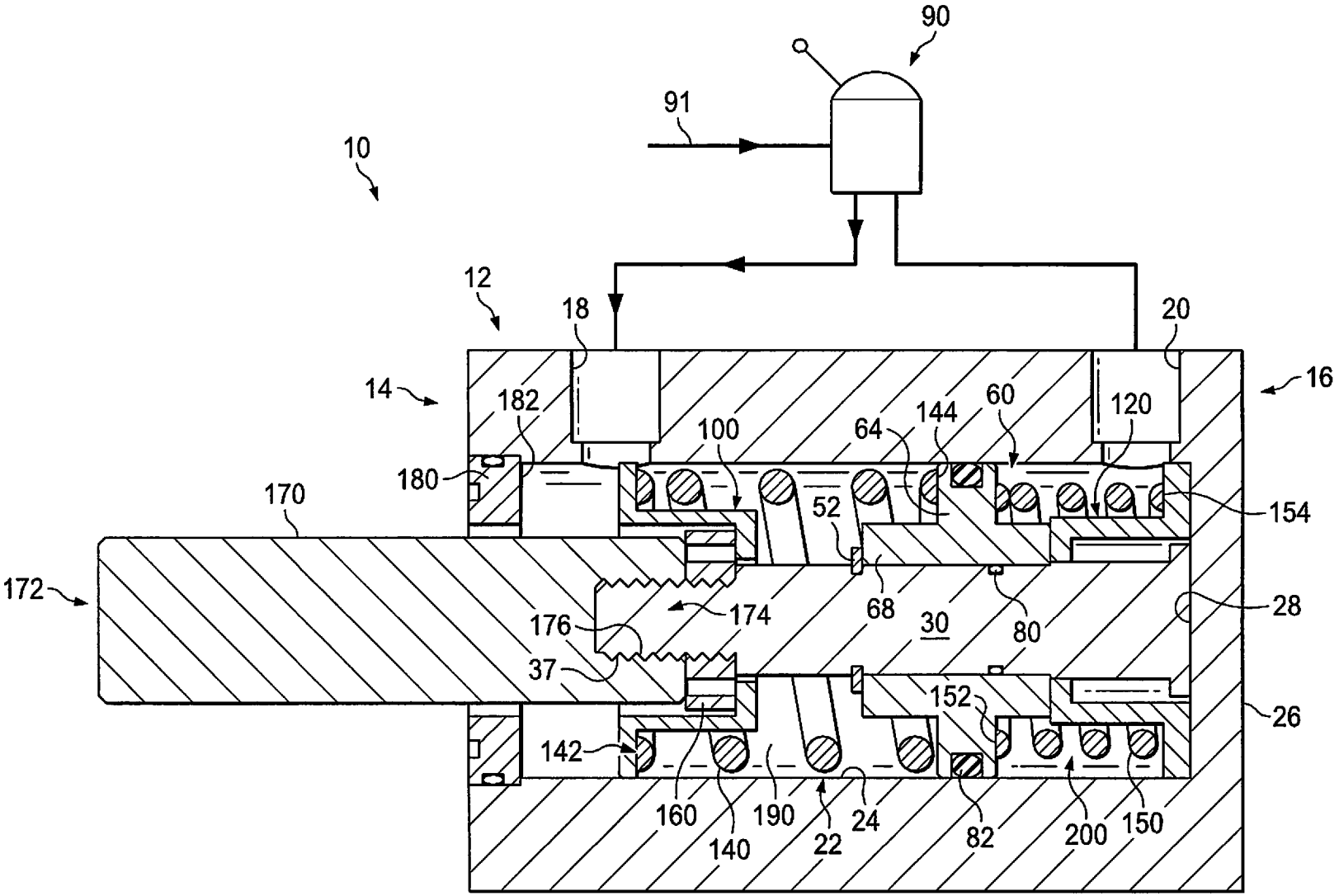
FIG. 7 is a schematic and cutaway elevational view of the control fluid actuator of FIG. 5 shown in a retracted position.

Referring now to FIGS. 5-7, shown is a position proportional control fluid actuator designated generally 10. Fluid actuator 10 includes body 12 defining a first end 14, a second end 16, a first fluid passageway 18, a second fluid passageway 20, and a bore 22. Bore 22 defines interior wall 24. Second end 16 has an end wall 26 defining an interior surface 28.

Figure 8:
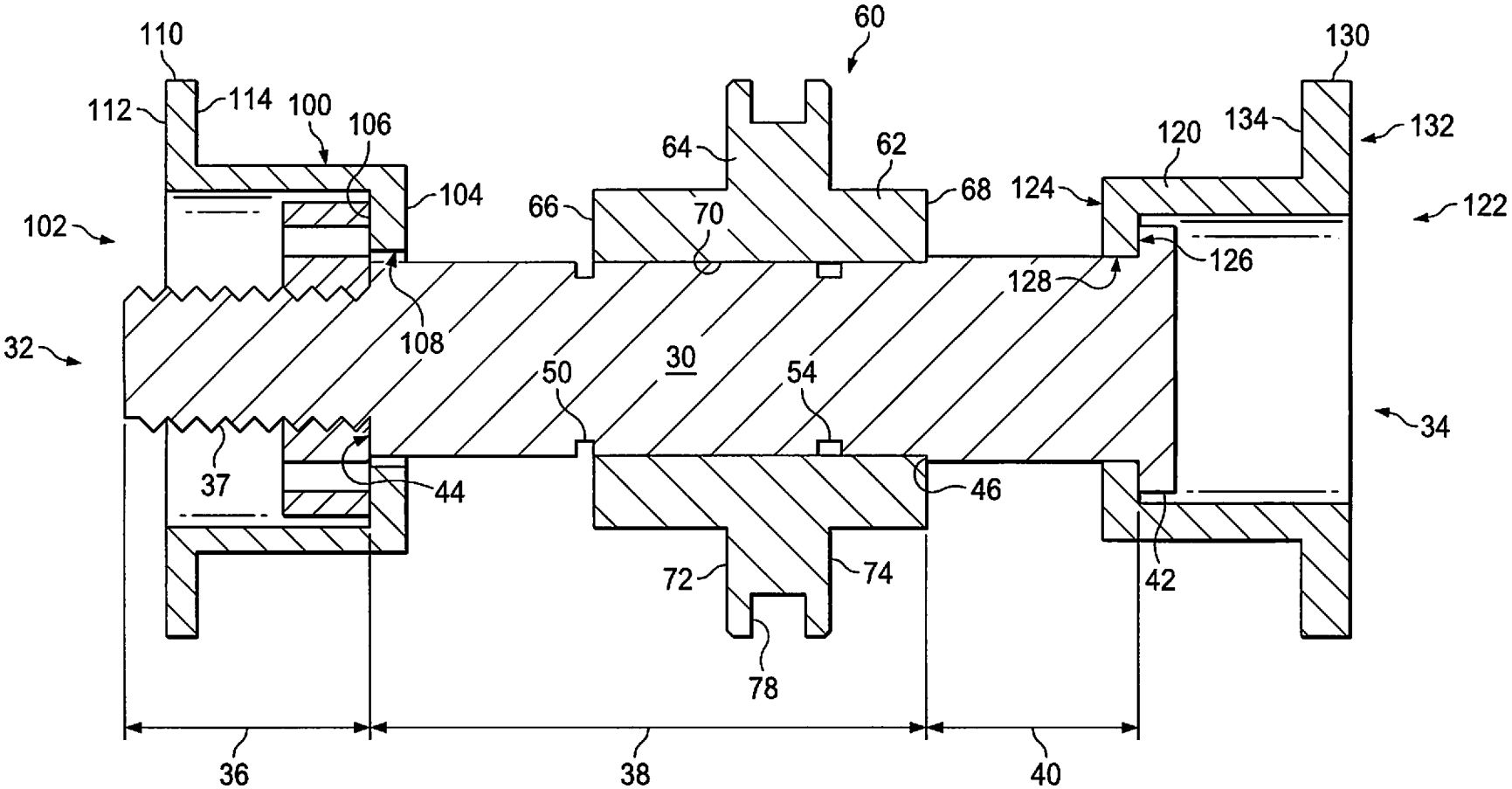
FIG. 8 is a schematic view of internal components of the control fluid actuator of the of FIGS. 5-7.

Piston shaft 30 is received in bore 22. Referring now primarily to FIG. 8, piston shaft 30 has a first end 32 and a second end 34. Piston shaft 30 further defines a threaded portion 36 adjacent to first end 32, a central portion 38 having a larger diameter than threaded portion 36, and a third portion 40 defining a larger diameter than central portion 38. Threaded portion 36 defines external threads 37. Piston shaft 30 further defines lip 42 adjacent to second end 34. Lip 42 has a larger diameter than third portion 40. Piston shaft 30 defines first step 44 between threaded portion 36 and central portion 38. Piston shaft 30 also defines second step 46 between central portion 38 and third portion 40. Piston shaft 30 additionally defines third step 48 between third portion 40 and lip 42.

Piston shaft 30 defines snap ring groove 50 on central portion 38 between first step 44 and second step 46. Snap ring 52 (FIGS. 5-7) is located in snap ring groove 50.

Piston shaft 30 further defines O-ring groove 54 on central portion 38 between snap ring groove 50 and third step 48.

Piston member 60 has a piston cylinder 62 and piston disk 64. Piston cylinder 62 surrounds piston shaft 30. Piston cylinder 62 has first end 66, second end 68, and inside surface 70. Second end 68 abuts third step 48 of piston shaft 30. First end 66 is adjacent snap ring 52 for retaining piston cylinder 62 on piston shaft 30. Piston disk 64 is positioned between first fluid passageway 18 and second fluid passageway 20. Piston disk 64 has a first side 72, a second side 74, and an external circumference defining channel 78. O-ring 80 is located in O-ring groove 54 of piston shaft 30. O-ring 80 is in sealing engagement with inside surface 70 of piston cylinder 62. Seal 82 is located in channel 78 of piston disk 64. Seal 82 is providing sealing engagement with interior wall 24 of bore 22.

Fluid pressure supply switch 90 is provided for selectively routing fluid from forward pressure supply 91 to first fluid passageway 18 and second fluid passageway 20 for selectively moving piston member 60 longitudinally within bore 22 of body 12.

A first flange bushing 100 defines an open end 102 and a closed end 104. Closed end 104 defines first inside surface 106 and first orifice 108 for receiving third portion 38 of piston shaft 30. Open end 102 defines first collar 110 having first end surface 112 and first spring receiving surface 114.

Second flange bushing 120 defines open end 122 and closed end 124. Closed end 124 defines second inside surface 126 and second orifice 128 for receiving central portion 40 of piston shaft 30. Open end 122 defines a second collar 130 having a second end surface 132 and second spring receiving surface 134.

Referring to FIGS. 5-7, first spring 140 has first end 142 and second end 144. First end 142 abuts first spring receiving surface 114 of first flange bushing 100. Second end 144 abuts first side 72 of piston disk 64.

Second spring 150 has first end 152 and second end 154. First end 152 abuts second side 74 of piston disk 64. Second end 154 abuts second spring receiving surface 134 of second flange bushing 120.

First securing nut 160 is received on threaded portion 36 of piston shaft 30. First securing nut 160 abuts first step 44 and is adjacent to first inside surface 106 of closed end 104 of first flange bushing 100.

Valve spool 170 has a first end 172 and a second end 174. Second end 174 defines internal threads 176 for receiving threaded portion 36 of piston shaft 30.

First seal ring 180 is adjacent first end 14 of body 12. First seal ring 180 is received within bore 22 of body 12. First seal ring 180 has inside surface 182. Inside surface 182 is for limiting travel of first flange bushing 100 by abutting against first end surface 112 of first flange bushing 100 when first spring 140 is at maximum compression.

First chamber 190 is defined by inside surface 182 of first seal ring 180, interior wall 24 of bore 22 and by first side 72 of piston disk 64.

Second chamber 200 is defined by interior surface 28 of end wall 26 of second end 16 of body 12, interior wall 24 of bore 22 and by second side 74 of piston disk 64.

First area of pressure application 210 is defined by (Area of piston disk 64)−(Area of the spool 170) and is located within first chamber 190.

Second area of pressure application 220 is defined by Area of piston disk 64 and is located within second chamber 200.

First area of pressure application 210 in first chamber 190 is less than second area of pressure application 220 in second chamber 200.

A preload and spring rate of first spring 140 is different than a preload and spring rate of second spring 150 for compensating for a difference between first area of pressure application 210 and second area of pressure application 220.

Embodiments of the present disclosure are well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this disclosure as defined by the claims.

The invention claimed is:

1. An actuator comprising:

a body defining a bore;

a piston in said bore, said piston having a first side and a second side, said first side partially defining a first chamber in said bore, said second side partially defining a second chamber in said bore;

a first spring on said first side of said piston, said first spring having a first spring rate and a first preload;

a second spring on said second side of said piston, said second spring having a second spring rate and a second preload, the second spring rate and the second preload being different than the first spring rate and the first preload;

a fluid pressure supply switch for selectively routing fluid to one of said first chamber and said second chamber for moving said piston in a desired direction;

wherein a preload and said first spring rate of said first spring is different than a preload and said second spring rate of said second spring for compensating for a difference between said first area of pressure application and said second area of pressure application.

2. The actuator according to claim 1 wherein:

said first chamber defines a first area of pressure application;

said second chamber defines a second area of pressure application; and wherein said first area of pressure application in said first chamber is greater than said second area of pressure application in said second chamber.

3. A method of operating a proportion control fluid actuator comprising the steps of:

positioning a fluid pressure supply switch for routing pressurized fluid to one of a first chamber and a second chamber, said first chamber and said second chamber having a piston therebetween;

wherein a first area of pressure application is in said first chamber;

wherein when said pressurized fluid is routed to said first chamber, said piston moves in a second direction, wherein movement of said piston is resisted by a second spring having a second spring rate;

wherein a second area of pressure application is in said second chamber;

wherein said first area of pressure application in said first chamber is greater than said second area of pressure application in said second chamber;

wherein when said pressurized fluid is routed to said second chamber, said piston moves in a first direction, wherein movement of said piston is resisted by a first spring having a first spring rate;

wherein a preload and said first spring rate of said first spring is different than a preload and said second spring rate of said second spring for compensating for a difference between said first area of pressure application and said second area of pressure application.

4. The method according to claim 3 wherein:

a starting pressure in said first chamber is equal to a sum of a preload of said second spring and the drag force of O-rings on said piston, said sum divided by said first area of pressure application in said first chamber.

5. The method according to claim 4 wherein:

said first area of pressure application in said first chamber is equal to an area of a first side of said piston.

6. The method according to claim 3 wherein:

an ending pressure in said first chamber is equal to sum of a preload of said second spring, a drag force of O-rings on said piston, said second spring rate of said second spring times a stroke length of said piston, said sum divided by said first area of pressure application in said first chamber.

7. The method according to claim 3 wherein:

a starting pressure in said second chamber is equal to a sum of a preload of said first spring and the drag force of O-rings on said piston, said sum divided by said first area of pressure application in said first chamber.

8. The method according to claim 3 wherein:

an ending pressure in said second chamber is equal to a sum of a preload of said first spring, a drag force of O-rings on said piston, said first spring rate of said first spring times a stroke length of said piston, said sum divided by said first area of pressure application in said first chamber.

9. The method according to claim 3 wherein:

said first area of pressure application in said first chamber is equal to an area of said piston minus an area of a spool.

10. A position proportional control fluid actuator comprising:

a body defining a first end, a second end, a first fluid passageway, a second fluid passageway, and a bore, said bore defining an interior wall, said second end of the body having an end wall defining an interior surface;

a piston shaft received in said bore, said piston shaft having a first end and a second end;

a piston member having a piston cylinder and a piston disk, said piston cylinder surrounding said piston shaft, said piston cylinder having a first end, a second end and an inside surface, said second end of the piston cylinder abutting a step of said piston shaft, said piston disk positioned between said first fluid passageway and said second fluid passageway, said piston disk having a first side, a second side and an external circumference defining a channel;

a fluid pressure supply switch for selectively providing fluid to said first fluid passageway and said second fluid passageway for selectively moving said piston member longitudinally within said bore of said body;

a first spring having a first end and a second end, said second end of the first spring abutting said first side of said piston disk;

a second spring having a first end and a second end, said first end of the second spring abutting said second side of said piston disk;

wherein a first chamber is adjacent said first side of said piston disk;

wherein said second chamber is adjacent said second side of said piston disk;

wherein a first area of pressure application is in said first chamber;

wherein a second area of pressure application is in said second chamber;

wherein said first area of pressure application in said first chamber is greater than said second area of pressure application in said second chamber.

11. The actuator according to claim 10 wherein:

said piston shaft further defining a threaded portion adjacent said first end of the piston shaft, a central portion having a larger diameter than said threaded portion, a third portion defining a larger diameter than said central portion, and a lip adjacent said second end of the piston shaft, said lip having a larger diameter than said third portion, said piston shaft defining a first step between said threaded portion and said central portion, said piston shaft defining a second step between said central portion and said third portion, said piston shaft defining a third step between said third portion and said lip.

12. The actuator according to claim 10 further comprising:

said piston shaft defining a snap ring groove on said central portion between said first step and said second step;

a snap ring in said snap ring groove;

said piston shaft defining an O-ring groove on said central portion between said snap ring groove and said second step;

said first end of said piston cylinder adjacent said snap ring for retaining said piston cylinder on said piston shaft.

13. The actuator according to claim 10 further comprising:

an O-ring located in said O-ring groove of said piston shaft, said O-ring for sealing engagement with said inside surface of said piston cylinder;

a seal located in said channel of said piston disk, said seal for providing sealing engagement with said interior wall of said bore.

14. The actuator according to claim 10 further comprising:

a first flange bushing defining an open end and a closed end, said closed end defining a first inside surface and a first orifice for receiving said central portion of said piston shaft, said open end defining a first collar having a first end surface and a first spring receiving surface;

a second flange bushing defining an open end and a closed end, said closed end defining a second inside surface and second orifice for receiving said third portion of said piston shaft, said open end defining a second collar having a second end surface and a second spring receiving surface.

15. The actuator according to claim 14 further comprising:

said first end of the first spring abutting said first spring receiving surface of said first flange bushing;

said first end of the second spring abutting said second spring receiving surface of said second flange bushing.

16. The actuator according to claim 10 further comprising:

a first seal ring adjacent said first end of said body and received within said bore, said first seal ring having an inside surface, said inside surface for limiting travel of said first flange bushing by abutting against said first end surface of said first flange bushing when said first spring is at maximum compression.

17. The actuator according to claim 10 further comprising:

a valve spool actuator having first end and a second end, said second end of the valve spool actuator defining internal threads for engaging said external threads of said threaded portion of said piston shaft.

18. The actuator according to claim 10 further comprising:

wherein a preload and spring rate of said first spring is different than a preload and spring rate of said second spring for compensating for a difference between said first area of pressure application and said second area of pressure application.

19. The actuator according to claim 10 wherein:

said first chamber is defined by said inside surface of said first seal ring, said interior wall of said bore, and by said first side of said piston disk; and said second chamber is defined by said interior surface of said end wall of said second end of said body, said interior wall of said bore and by said second side of said piston disk.

20. The actuator according to claim 10 wherein:

wherein a first area of pressure application is an area of said first side of said piston;

wherein a second area of pressure application is an area of said second side of said piston minus an area of said spool.

* * * * *